US005520343A

United States Patent [19]

Aika et al.

[11] Patent Number: 5,520,343

[45] Date of Patent: May 28, 1996

[54] EMPTY VESSEL TREATMENT VEHICLES

[75] Inventors: Osamu Aika, Yonago; Chikashi Okumura; Noboru Nishikouri, both of Matsue; Hajime Yonemura, Higashiizumomachi; Kuniyoshi Hidao, Matsue; Rikiya Miyakoda, Mihonosekimachi; Katsumi Kurihara, Matsue, all of Japan

[73] Assignee: B.S.C. Co., Ltd., Tokyo, Japan

[21] Appl. No.: 329,327

[22] Filed: Oct. 26, 1994

[51] Int. Cl.[6] ..... B02C 13/286; B02C 21/02

[52] U.S. Cl. ..... 241/99; 241/101.741; 241/186.35

[58] Field of Search ..... 241/60, 99, 101.74, 241/101.741, 101.742, 101.75, 101.76, 134, 135, 138, 186.35, 223

[56] References Cited

U.S. PATENT DOCUMENTS

| | | | |
|---|---|---|---|
| 727,807 | 5/1903 | King | 241/101.74 X |
| 2,210,093 | 8/1940 | Morrissey | 241/101.76 X |
| 2,325,719 | 8/1943 | Turner, Jr. | 241/101.76 X |
| 2,593,353 | 4/1952 | Shelton, Jr. | 241/101.76 X |
| 3,647,150 | 3/1972 | Stephanek | 241/101.76 X |
| 4,011,999 | 3/1977 | Glaeser | 241/186.35 X |
| 4,597,487 | 7/1986 | Crosby et al. . | |
| 4,787,495 | 11/1988 | Tuten et al. . | |
| 4,961,539 | 10/1990 | Deem | 241/101.741 X |

FOREIGN PATENT DOCUMENTS

| | | |
|---|---|---|
| 2-4483 | 1/1990 | Japan . |
| 3-118848 | 5/1991 | Japan . |

*Primary Examiner*—Timothy V. Eley

*Attorney, Agent, or Firm*—Frishauf, Holtz, Goodman, Langer & Chick

[57] ABSTRACT

A treatment vehicle for treating empty vessels such as empty bottles. A feed conveyor for carrying empty vessels introduced in a vehicle body is obliquely provided such that a starting end thereof faces to a rear of the vehicle body and a forward end thereof rises toward a front of the vehicle body. A treatment machine for treating the empty vessels to produce chips is provided beneath the forward end of the feed conveyor, and a hopper for receiving the chips produced by the treatment machine is provided in a space formed beneath the feed conveyor. A transport conveyor for transporting and guiding the chips from the treatment machine into the hopper is obliquely provided in a direction opposite to the feed conveyor, and the hopper is provided in the shape of a trapezoid in an angular space surrounded by the feed conveyor and the transport conveyor.

3 Claims, 6 Drawing Sheets

EMPTY VESSEL TREATMENT VEHICLES

BACKGROUND OF THE INVENTION

1. Field of the Invention

This invention relates to a vehicle (such as a truck) mounted with equipment for crushing empty vessels such as empty bottles or for carrying out other treatment.

2. Description of the Prior Art

As apparatus for crushing empty bottles or the like to make their treatment, those disclosed in Japanese Patent Applications Laid-open No. 2-4483 No. 3-118848, etc. are hitherto known in the art. Treatment vehicles or trucks are also known such that a treatment apparatus, a feed conveyor for lifting empty bottles or the like introduced, to carry them up to a feed opening of the treatment apparatus, a hopper for receiving chips obtained after crushing, and a transport conveyor for transporting the chips from the treatment apparatus into the hopper are altogether mounted on the body of a running vehicle.

In conventional treatment vehicles, however, since the chips are discharged from the rear of the hopper, the hopper is provided at a forward position, or on the side, of the feed conveyor for lifting empty vessels from the rear of the vehicle body to carry them into the hopper. Hence, space for setting up the feed conveyor and space for setting up the hopper must be left on the vehicle body, so that the whole space on the vehicle body becomes short and the space for setting up other machinery becomes small to cause difficulties in the maintenance of the apparatus. To eliminate such difficulties, the conveyors, the hopper and so forth must be made smaller in size and the whole treatment capacity can not help being curtailed.

The conventional treatment vehicles as stated above are also of a type in which, when the chips received in the hopper are secondarily treated for regeneration or discarded for reclamation, the chips are discharged by raising the whole treatment apparatus including conveyors to tilt the deck for dumping or by manually raking out the chips. Such discharge operation is accompanied with some danger, or an oil-pressure drive mechanism for the dumping must be provided. Such disadvantages have been unsettled.

SUMMARY OF THE INVENTION

Accordingly, an object of the present invention is to provide a treatment vehicle for treating empty vessels such as empty bottles, that can effectively utilize the space on the body thereof and has a larger capacity of a chips-receiving hopper.

Another object of the present invention is to provide a treatment vehicle for treating empty vessels such as empty bottles, that can discharge chips from a chips-receiving hopper to the outside with ease, and can achieve a simplification of the mechanism and a low cost.

To achieve the above objects, the treatment vehicle of the present invention for treating empty vessels such as empty bottles comprises a feed conveyor for carrying up empty vessels introduced in a vehicle body, obliquely provided in the manner that its starting end faces to the rear of the vehicle body and its forward end rises toward the front of the vehicle body; a treatment machine for treating the empty vessels carried in, provided beneath the forward end of the feed conveyor; and a hopper for receiving chips obtained through the treatment machine, provided in the space formed beneath the feed conveyor.

In a preferred embodiment of the present invention, a transport conveyor for carrying up the chips obtained through the treatment machine to transport and guide them into the hopper is obliquely provided in the direction opposite to the feed conveyor, and the hopper is provided in the shape of a trapezoid in the angular space surrounded by the feed conveyor and the transport conveyor.

In another preferred embodiment of the present invention, a conveyor for discharging the chips is provided at the bottom inside the hopper in the manner that it backward extends in the rear of the rear-wheel position of the vehicle body, and a discharge outlet of the conveyor is provided downward in the rear of the rear-wheel position.

In a still another preferred embodiment of the present invention, the conveyor for discharging the chips is comprised of a screw conveyor, and the discharge end of the screw conveyor is provided at a position different from the position of the starting end of the feed conveyor in the right-and-left direction.

According to the present invention, the empty vessels carried in by the feed conveyor are treated by a treatment machine such as a crusher, and the chips obtained are transported to the hopper on the vehicle body and received therein. After the treatment of the empty vessels has been completed, the chips are discharged accordingly from the hopper to the outside of the vehicle body.

In the present invention, the lower space of the feed conveyor obliquely provided on the vehicle body is effectively utilized to set up the hopper, and hence not only the hopper can be made larger in size to ensure a larger space for receiving the chips but also the area in which the equipments necessary for treating empty vessels are set up on the vehicle body can be made larger.

When in a preferred embodiment of the present invention a transport conveyor for carrying the chips obtained through the treatment machine to guide them into the hopper is obliquely provided in the direction opposite to the feed conveyor and the hopper is provided in the shape of a trapezoid in the angular space surrounded by the feed conveyor and the transport conveyor, it is possible to save space to make the capacity of the hopper maximum.

When in another preferred embodiment of the present invention a conveyor for discharging the chips is provided at the bottom inside the hopper in the manner that it backward extends in the rear of the rear-wheel position of the vehicle body, and a discharge outlet of the conveyor is provided downward in the rear of the rear-wheel position, it is possible to discharge the chips without raising the conveyors, the hopper and a large quantity of chips to dump the chips, so that it becomes unnecessary to provide any oil-pressure drive mechanism, to thereby achieve a cost reduction, end also the discharging at regeneration factories or reclaiming lands can be operated in safe.

Also when in a still another preferred embodiment of the present invention, the conveyor for discharging the chips is comprised of a screw conveyor and the discharge end of the screw conveyor is provided at a position different from the position of the starting end of the feed conveyor in the right-and-left direction, it is possible in the maintenance or exchange of a screw to draw out or insert the screw from the discharge end of the screw conveyor with ease.

DESCRIPTION OF THE PREFERRED EMBODIMENTS

Figure 1:
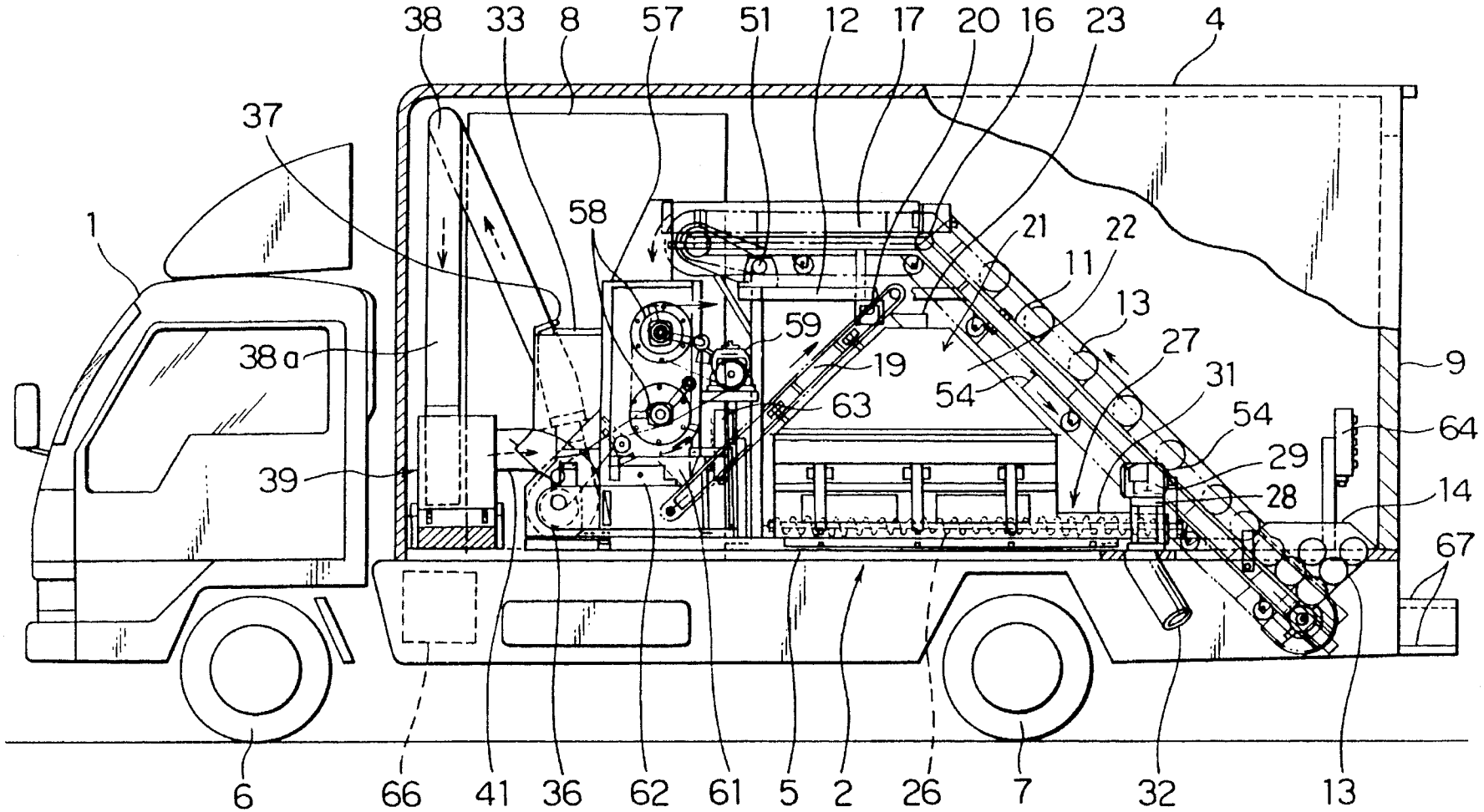
FIG. 1 is a partially sectional side view to illustrate the whole structure of an empty vessel treatment truck according to the present invention.
Figure 2:
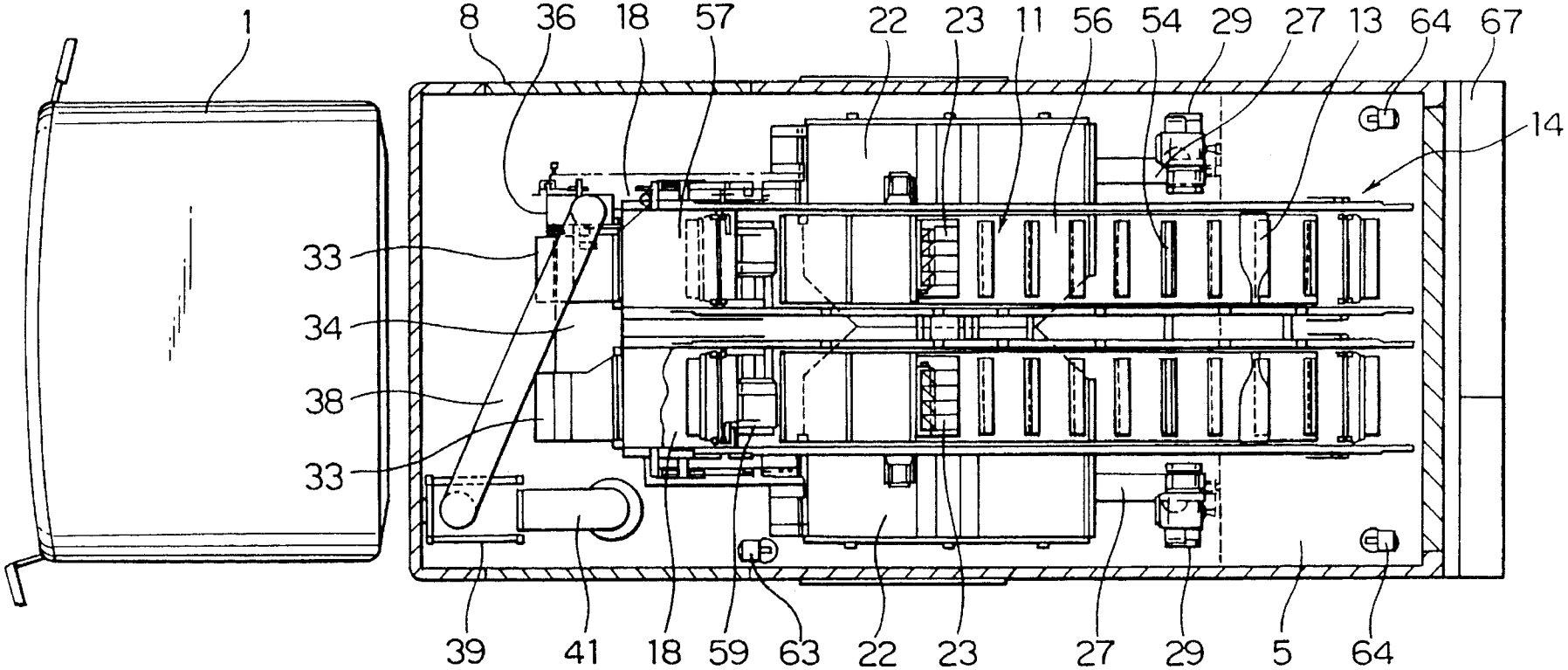
FIG. 2 is a partially sectional plan view to illustrate the whole structure of the empty vessel treatment truck.
Figure 3:
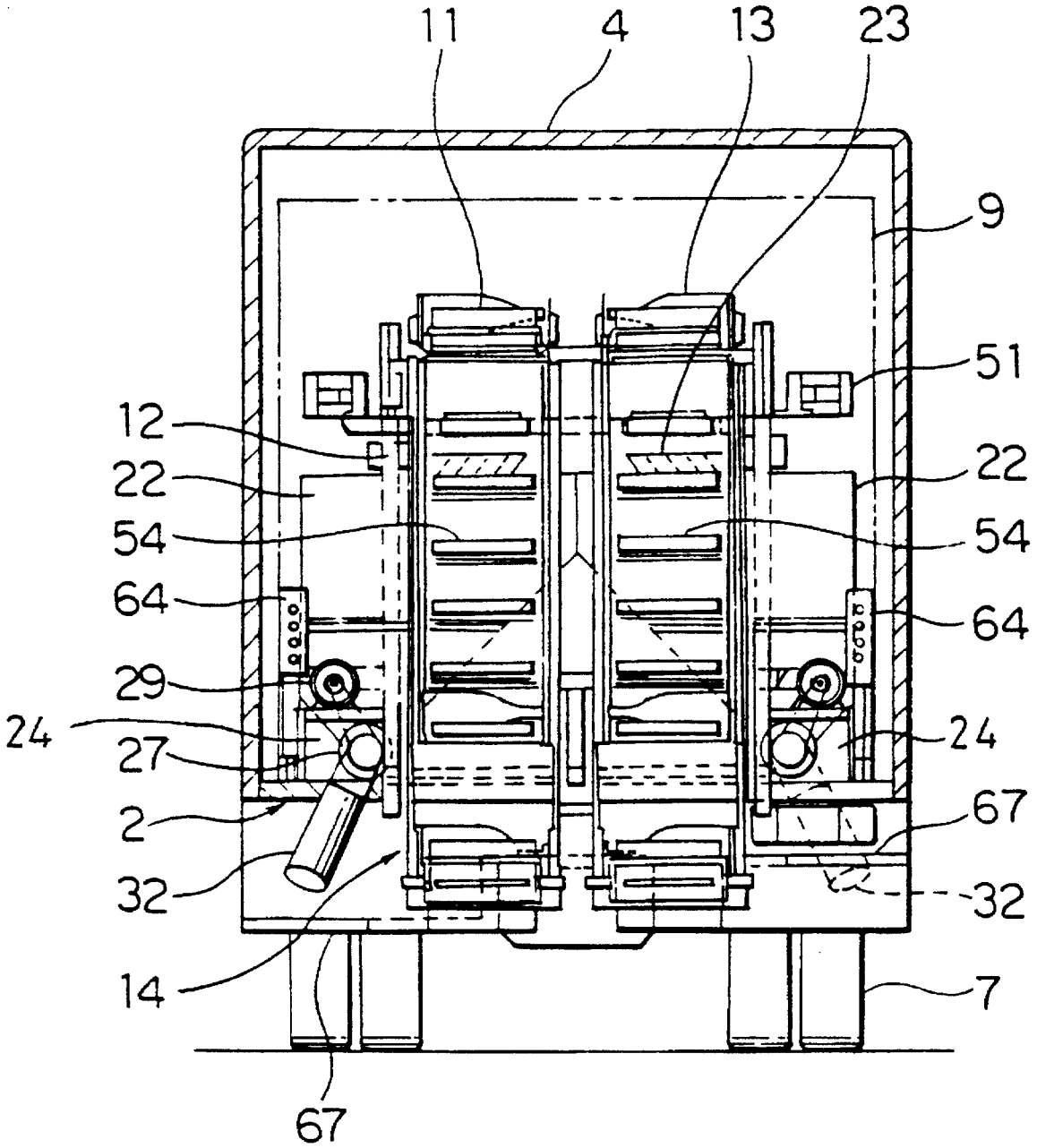
FIG. 3 is a partially sectional rear view of the empty vessel treatment truck.

Preferred embodiments of the present invention will be described below with reference to accompanying drawings. FIGS. 1 to 3 show a side view, a plan view and a rear view, respectively, of a treatment truck mainly used for crushing empty bottles for their treatment. On a vehicle body 2 at the rear of a driver's seat 1, a boxlike container cover 4 made of a soundproofing material is mounted, in which all equipment necessary for carrying empty bottles or the like in the vehicle body, crushing them, transporting and stocking chips, and so forth are received. Front wheels 5 and rear wheels 7 are respectively provided beneath the driver's seat 1 and at the rear half portion of the vehicle body 2.

Doors 8 and 9 that can be freely opened and closed are provided at both sides and the rear of the container cover 4. On a floor 5, at the middle thereof on the inside, right and left two lines of feed conveyors 11 are provided in the manner that they obliquely rise toward the front by the aid of a support frame 12. A feed hopper 14 from which empty bottles (empty vesseles) are introduced in the starting end of the feed conveyor is also provided at the rear end of each feed conveyor 11.

At the front end of the feed conveyor 11, a forward extending portion 17 having a given length and a substantially flat surface is formed through a bent or curved portion 16. Beneath the forward end portion at which the carrying of empty bottles is finished, a crusher 18 for crushing the empty bottles 13 (which is replaced with a treatment machine such as a pressure breaking machine when empty cans or the like are to be treated) is provided correspondingly to each feed conveyor 11. This crusher 18 may be the conventionally known crusher previously described.

Beneath the crusher 18, the starting end of a transport conveyor 19 is positioned, which is comprised of a belt conveyor that receives chips and carries up the chips to transport them rearward. The transport conveyor 19 is fitted to the support frame 12, is positioned beneath the forward extending portion 17 of the feed conveyor 11, and is obliquely provided in the manner that its rearward end rises toward the bent portion 16 of the feed conveyor 11, where the bottom surfaces of the transport conveyor 19 and feed conveyor 11 form a substantially triangular, cornered spatial zone 21. Reference numeral 20 denotes a drive motor for the transport conveyor 19, which is fitted to the support frame 12.

In the spatial zone 21, a hopper 22 is formed which is comprised of right and left two sets or two chambers and has, in its side view, an angular shape at the upper part along the slopes of the spatial zone 21 and a rectangular shape at the lower part in the front-and-rear direction and, in its rear view, perpendicular rise surfaces at the outer sides and inner-wall surfaces downward tilting toward the outside lower positions from the middle position of the feed conveyors 11. At the top of each set or chamber of the hopper 22, a feed inlet 23 with a guide plate is provided, through which the chips dropping from the forward end of each transport conveyor 19 are introduced into the hopper 22 and the chips are dropwise collected toward the bottom 24 of the hopper, formed at the outside position of each feed conveyor 11 in the shape converging into a funnel in its rear view.

To each bottom 24 of the hopper 22, a discharge conveyor 27 comprised of a screw extending in the front-and-rear direction is inserted, and is chain-driven at the rear end portion by means of a motor 29 provided on a base 28. To each discharge conveyor 27, a discharge outlet 32 is connected, which outward opens at the rear-end lower part of a cylindrical case 31 of the discharge conveyor 27. The discharge outlet 32 is positioned to the rear of the rear wheels 7, and hence, when the chips are discharged from the hopper 22, they can be directly discharged by only moving the vehicle so that its rear end portion may face on a reclaiming land or a receiver container (not shown). Also, since each screw 26 of the discharge conveyor 27 is provided at a position where no obstacle is present in the rear (a position outward deviating from the position of the feed conveyor 11), the screw can be inserted to or detached from the vehicle body at the rear thereof for its assemblage or disassemblage.

In the rear of each crusher 18, a dust box for receiving labels, caps, covers and so forth that may fly about during the crushing of empty bottles is connected, where right and left dust boxes are connected with a duct at their middle portions to communicate with each other and also a blower 36 for suction is connected to the right dust box 33 at its bottom outside surface so that fine dust produced and floating inside the crushers 18 and dust boxes 33 during the treatment can be sucked. An intake opening 37 is provided above each dust box 33.

The blower 36 is connected, on the exhaust side thereof, with one end of an air duct 38 comprised of a large curved pipe in the form of a gate (or in a U-shape) at its middle portion, and the other end of the air duct 38 is connected to a dust collector 39 provided at the front left side on the vehicle body. The dust sucked and discharged through the blower 36 is collected in the dust collector 39. To the dust collector 39, an exhaust tube 41 is provided whose end is made to downward open from the floor 5 toward the lower part.

Figure 6:
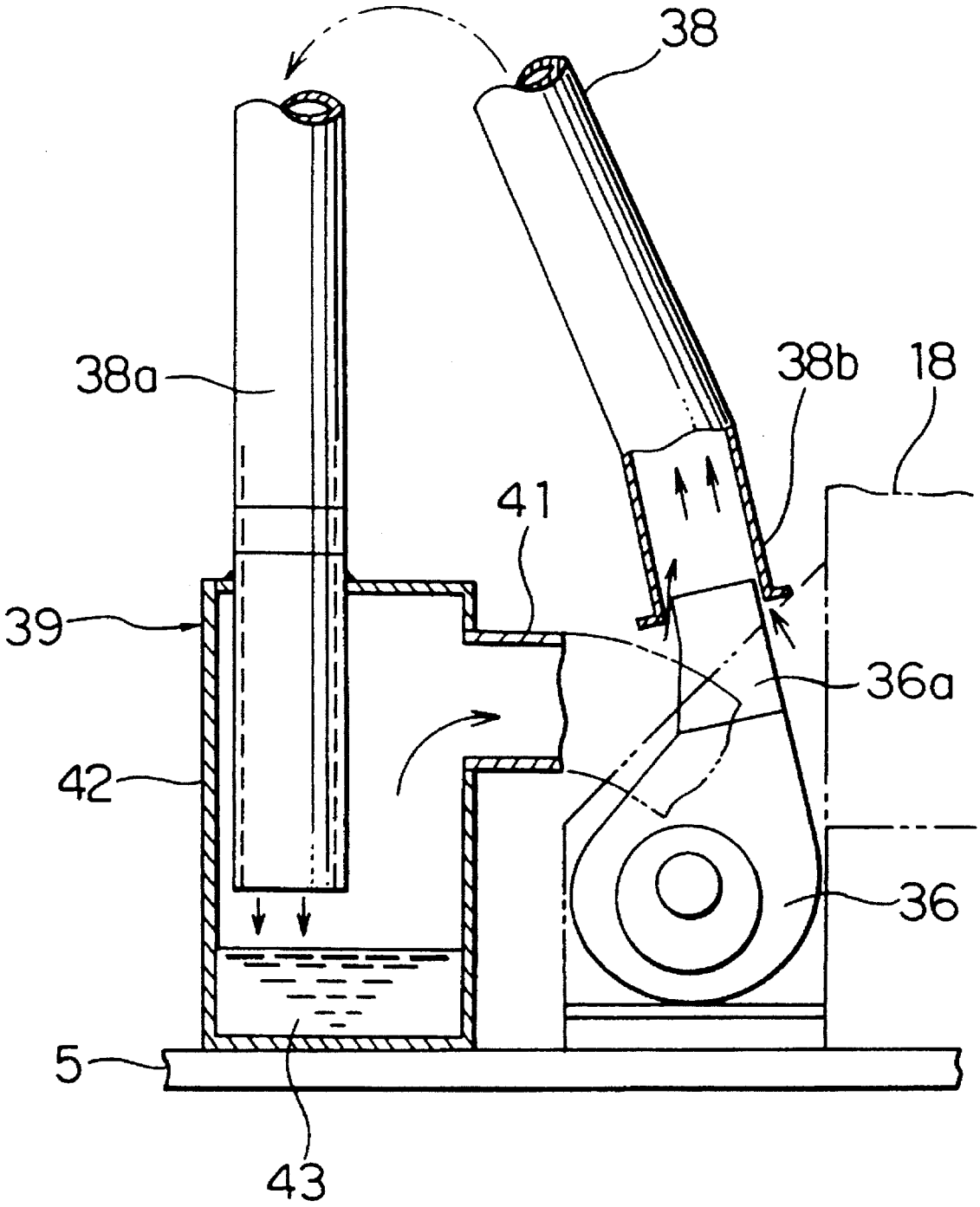
FIG. 6 is a sectional side elevation of a dust collector of the empty vessel treatment truck.

The dust collector 39 has, as shown in FIG. 6, a boxlike dust collection chamber 42, at the bottom of which a dust collection liquid (water) 43 is held and also from the top of which the air duct 38 extending from the blower 36 is inserted in the manner that it downward opens. The air duct 38 has a straight portion **38*a* with a given length at its end portion connected to the dust collection chamber 42, which is substantially vertically inserted to the inside of the dust collection chamber 42 from the upper part thereof and opens in proximity to the liquid surface of the dust collection liquid 43. The exhaust tube 41 is, at its base connecting end, connected to the peripheral wall of the dust collection chamber 42 at a position higher than the lower end position of the air duct 38 and opens to the inside. At the other end thereof, which is curved in an elbow, it downward passes through the floor 5** and opens to the outside.

On account of the structure thus taken, the dust-containing air sent from the blower 36 flows straight at the straight portion **38*a* of the air duct 38, where solid dust having a weight collides against the liquid surface and is catalytically separated therefrom and only clean air is discharged outside through the exhaust tube 41**.

Figure 5:
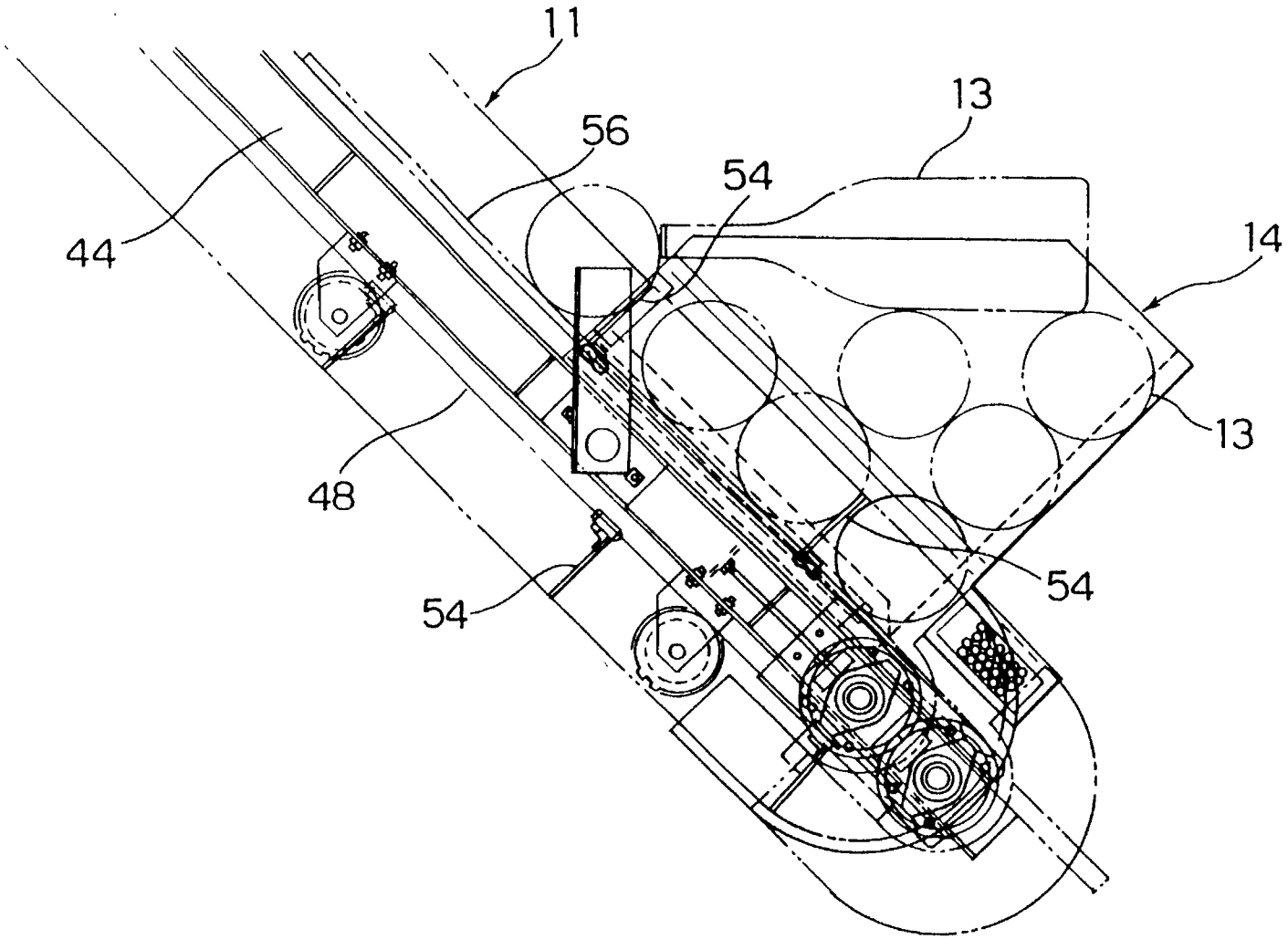
FIG. 5 is an enlarged sectional view of a starting end of the feed conveyor of the empty vessel treatment truck.

At the part where the air duct 38 is connected to the blower 36, as shown in FIG. 5, an air outlet of the blower 36 is inserted to the air duct 38 in the manner that an exhaust opening 36*a* of the former faces the inside of a base connecting end 38*b* of the latter and a circular gap is formed between their peripheral walls. Thus, on account of this structure, not only the dust inside the crusher 18 but also the dust floating inside the container room can be sucked during the drive of the blower.

Figure 4:
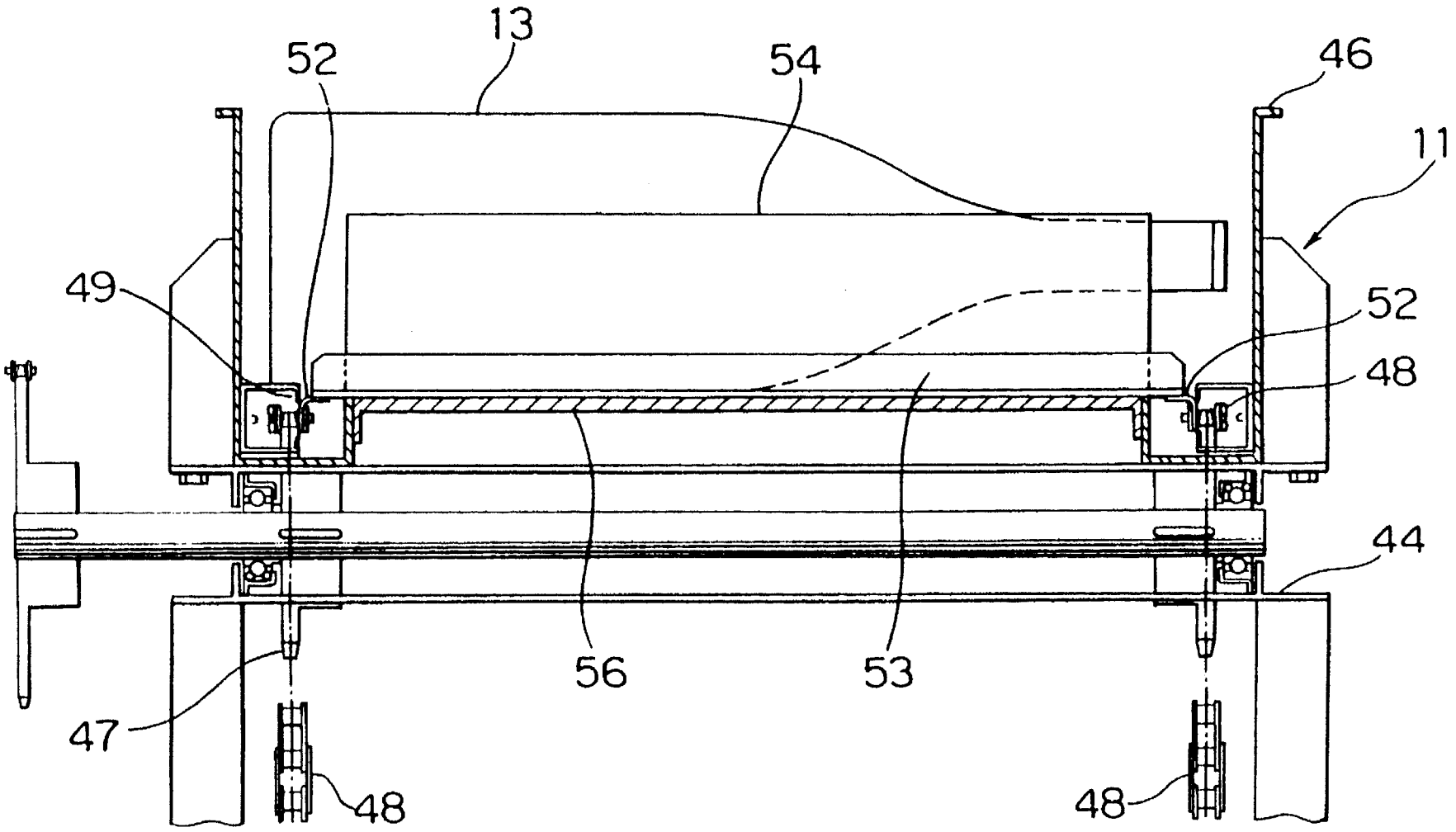
FIG. 4 is an enlarged sectional view of a feed conveyor of the empty vessel treatment truck.

The feed conveyor 11 and the crusher 18 will be described below in greater detail. The feed conveyor 11 is, as shown in FIG. 4, supported on a conveyor frame 44. Transport guides 46 for preventing the empty bottles 13 from dropping are provided on both sides of the conveyor frame 44. On the inside of each base portion of the transport guides 46, a chain guide 49 having a C-shaped cross section is provided. A cable member comprised of a chain 48 (or a belt) hooked around sprockets 47 (or a pulley) is stretched and is supported in the state that it is inserted to each chain guide 49. The chain 48 is transportably driven by a motor 51 provided on the support frame 12. A flat-sheetlike bottom guide 56 for receiving the empty bottles 13 is also provided between the right and left transport guides 46.

Between right and left chains 48 and 48, stays 53 each having an angular cross section are provided at given intervals via attachment members 52. These stays move on the bottom guide 56 in slidable contact therewith as the chains 48 and 48 are driven. To each of these stays 53, a lifting plate 54 is fitted in the manner that it is vertical to the bottom guide 56. The bottom guide 56 may not necessarily be flat-sheetlike, and may also be in the form of lattices or rails longitudinally provided along the drive direction of the conveyor.

As the chains are driven, the lifting plates 54 and the stays 53 move while they come in slidable contact with the top surface of the bottom guide 56. Then the empty bottles 13 are pushed by the lifting plates 54 in the state they are put on the top surface of the bottom guide 56, and are thus transported in the drive direction of the conveyor. At this stage, the empty bottles 13 are in a state of slidable contact with the bottom guide 56 and lifting plates 54. In the case when they have round cross sections as shown in the drawings, they are conveyed while tumbling.

The height of each lifting plate 54 is preferably not less than the height corresponding to the radius of each empty bottle 13 of a round cross section. It is enough for the height to be ½ or more of the radius of a 1.8 liter bottle, usually considered to be a large-sized bottle.

Above each crusher 18, a feed guide 57 is provided in the manner that it surrounds the front end of the extending portion 17 of the feed conveyor 11. The feed guide 57 prevents the empty bottles 13 from dropping outside when the empty bottles 13 are introduced from the front end of the forward extending portion 17 of the feed conveyor 11 into each crusher 18.

The crusher 18 has a built-in crushing means (not shown) such as a built-in rotary hummer. In the example shown in the drawings, it is so structured that upper and lower two rotors 58 are rotationally driven by one motor 59 via a chain or a belt and also that the lower rotor 58 is driven in association with the blower 36 previously described. The blower 36 may also be driven by a motor exclusively used therefor. A discharge duct 61 through which the chips held in the crusher are dropped on the starting end of the transport conveyor 19 is provided beneath each crusher 18. At a forward portion of the duct 61, a drawer type dust box 56 for receiving the dust accumulated inside is provided.

Reference numeral 63 denotes an operation panel for actuating or stopping the discharge conveyor 27, the operation panel 63 being provided on a side at the lower end of each transport conveyor 19. Operation panels 64 for actuating, stopping or providing automatic drive of the right and left feed conveyors 11, crushers 18, transport conveyors 19 and blowers 36 are also provided at both the right and left sides in the rear of the floor 5. A dynamo 66 for driving the respective motors is also provided inside at the front of the vehicle body 2, and a step 67 where operators can get on and off is projectingly formed at the rear end of the vehicle body 2.

In the apparatus constructed as described above, collection and treatment of different kinds of objects as exemplified by crushing of empty bottles and pressure breaking of empty cans, crushing of colored empty bottles and colorless empty bottles or pressure breaking of empty aluminum cans and empty steel cans can be simultaneously carried out in parallel. In the case when empty cans are treated, it is necessary to install known empty-can pressure-breaking machines (not shown) in place of the crushers 18 in the foregoing embodiments.

According to the treatment vehicle of the present invention, constructed as described above, the space formed beneath the conveyors obliquely provided is effectively utilized to install the hopper, and hence has the advantages that not only the hopper can be made larger in size to ensure a large space for receiving chips, but also the area in which all the equipment necessary for operating the treatment of empty vessels are installed on the vehicle body can be made larger.

What is claimed is:

1. A treatment vehicle for treating empty vessels, comprising:

a feed conveyor for carrying empty vessels introduced in a vehicle body, said feed conveyor being obliquely provided such that a starting end thereof faces to a rear of the vehicle body and a forward end thereof rises toward a front of the vehicle body;

a treatment machine for treating the empty vessels to produce chips, said treatment machine being provided beneath the forward end of the feed conveyor;

a hopper for receiving the chips produced by the treatment machine, said hopper being provided in a space formed beneath the feed conveyor; and a transport conveyor for transporting and guiding the chips from the treatment machine into the hopper, said transport conveyor being obliquely provided in a direction opposite to the feed conveyor; and wherein the hopper is provided in the shape of a trapezoid in an angular space surrounded by the feed conveyor and the transport conveyor.

2. The treatment vehicle according to claim 1, wherein a conveyor for discharging the chips is provided at a bottom inside of the hopper such that said discharging conveyor extends rearwardly of a rear-wheel position of the vehicle body, and a discharge outlet of the discharging conveyor is provided extending downwardly therefrom rearwardly of the rear-wheel position of the vehicle body.

3. The treatment vehicle according to claim 2, wherein said conveyor for discharging the chips comprises a screw conveyor having a discharge end provided at a position laterally offset from the starting end of the feed conveyor.

* * * * *